US011672345B2

(12) United States Patent
Wu

(10) Patent No.: US 11,672,345 B2
(45) Date of Patent: Jun. 13, 2023

(54) SPRING-TYPE IRON FRAME MESH CHAIR

(71) Applicant: DXRACER TECHNOLOGY WUXI CO., LTD., Jiangsu (CN)

(72) Inventor: Qing Wu, Jiangsu (CN)

(73) Assignee: DXRACER TECHNOLOGY WUXI CO., LTD., Wuxi (CN)

( * ) Notice: Subject to any disclaimer, the term of this patent is extended or adjusted under 35 U.S.C. 154(b) by 0 days.

(21) Appl. No.: 17/626,287

(22) PCT Filed: Jul. 23, 2020

(86) PCT No.: PCT/CN2020/103780
§ 371 (c)(1),
(2) Date: Jan. 11, 2022

(87) PCT Pub. No.: WO2021/114678
PCT Pub. Date: Jun. 17, 2021

(65) Prior Publication Data

US 2022/0287464 A1 Sep. 15, 2022

(30) Foreign Application Priority Data

Dec. 12, 2019 (CN) ..... 201922234893.7

(51) Int. Cl.
*A47C 7/34* (2006.01)
*A47C 7/28* (2006.01)

(52) U.S. Cl.
CPC ..... *A47C 7/347* (2013.01); *A47C 7/282* (2013.01)

(58) Field of Classification Search
CPC ..... A47C 7/347; A47C 7/345; A47C 7/282; A47C 7/28; A47C 1/143; A47C 3/00; A47C 5/04
See application file for complete search history.

(56) References Cited

U.S. PATENT DOCUMENTS 3,098,646 A 7/1963 Knabusch et al.
3,178,221 A * 4/1965 Schwarz ..... B60N 2/7064 297/284.4

(Continued)

FOREIGN PATENT DOCUMENTS

CN 2459978 Y 11/2001
CN 202287216 U 7/2012

(Continued)

*Primary Examiner* — Milton Nelson, Jr.

(57) ABSTRACT

The present invention belongs to the technical field of mesh chairs, in particular to a spring-type iron frame mesh chair, wherein it comprises a chair body, and a reinforcement is fixed to the side of the chair body by welding. A mesh body is fixed on the side surface of the reinforcement. Spring bodies are fixed on the inner side of the reinforcement by welding. A connecting ring is connected to one end of the spring bodies different from the reinforcement. An adjusting rod is integrally arranged on the side surface of the chair body. The adjusting rod penetrates the side wall of the chair body. When the mesh chair is in use, the spring bodies can pull the reinforcement by their own elasticity. Pressure is applied to the reinforcement and the spring bodies when the mesh body is under pressure, so that the mesh body becomes flexible and elastic to a certain extent, which improves the user experience. When the adjusting rod is adjusted, the position of the connecting ring is changed simultaneously and the length of the spring bodies varies, then the elasticity of the spring bodies is changed, which makes it easy to adjust the elasticity of the mesh body and improve the user experience.

6 Claims, 2 Drawing Sheets

(56) References Cited

U.S. PATENT DOCUMENTS

| | | | | | |
|---|---|---|---|---|---|
| 3,289,220 | A * | 12/1966 | Grimshaw | ..... | A47C 23/20 5/220 |
| 6,584,627 | B1 * | 7/2003 | Yang | ..... | A47C 23/26 5/174 |

FOREIGN PATENT DOCUMENTS

| | | | |
|---|---|---|---|
| EP | 0119551 | A2 * | 9/1984 |
| JP | S5934658 | U | 3/1984 |
| JP | H01131349 | U | 9/1989 |
| WO | WO-2005/034691 | A2 | 4/2005 |

* cited by examiner

SPRING-TYPE IRON FRAME MESH CHAIR

FIELD OF THE INVENTION

The present invention belongs to the technical field of mesh chairs, in particular to a spring-type iron frame mesh chair.

BACKGROUND OF THE INVENTION

The mesh stretching for E-sports chairs on the current market is mostly performed by fixing mesh on plastic frame with reinforced steel nails by nail gun. The mesh after being fixed with gun nails only has its own elasticity which is low and affected by properties of plastic itself. The pressure generated by a person sitting on a chair directly acts on the mesh and indirectly acts on the frame. The restoring force generated acts on the person itself, showing the mesh is not elastic enough and brings discomfort to users. To solve the problem existing in the use of mesh chairs, it is necessary to improve and optimize the structure of mesh chairs.

SUMMARY OF THE INVENTION

In order to solve the above-described problems in the prior art, the present invention provides a spring-type iron frame mesh chair, which effectively improves the mesh elasticity of mesh chairs.

In order to achieve the above purpose, the present invention provides the following technical solutions: a spring-type iron frame mesh chair, wherein it comprises a chair body, and a reinforcement is fixed to the side of the chair body by welding. A mesh body is fixed on the side surface of the reinforcement. Spring bodies are fixed on the inner side of the reinforcement by welding. A connecting ring is connected to one end of the spring bodies different from the reinforcement. An adjusting rod is integrally arranged on the side surface of the chair body. The adjusting rod penetrates the side wall of the chair body.

As the preferred technical scheme, the present invention provides a spring-type iron frame mesh chair, wherein threads are evenly arranged on the outer surface of the adjusting rod. A swivel is sleeved through screw threads on the outer surface at one end of the adjusting rod different from the connecting ring.

As the preferred technical scheme, the present invention provides a spring-type iron frame mesh chair, wherein grooves are evenly opened on the outer surface of the adjusting rod. Convex strips embedded into the adjusting rod are arranged on the inner wall of the chair body.

As the preferred technical scheme, the present invention provides a spring-type iron frame mesh chair, wherein three spring bodies are arranged at an angle of 60° between adjacent two spring bodies.

As the preferred technical scheme, the present invention provides a spring-type iron frame mesh chair, wherein a protective frame is arranged at the outer side of the reinforcement. Both ends of the protective frame are connected to the chair body by welding.

As the preferred technical scheme, the present invention provides a spring-type iron frame mesh chair, wherein the swivel is an annular component. Rotating rods are arranged at both ends of the swivel.

Compared with the prior art, the present invention has the following beneficial effects: When the mesh chair is in use, the spring bodies can pull the reinforcement by their own elasticity. Pressure is applied to the reinforcement and the spring bodies when the mesh body is under pressure, so that the mesh body becomes flexible and elastic to a certain extent, which improves the user experience. When the adjusting rod is adjusted, the position of the connecting ring is changed simultaneously and the length of the spring bodies varies, then the elasticity of the spring bodies is changed, which makes it easy to adjust the elasticity of the mesh body and improve the user experience.

BRIEF DESCRIPTION OF THE DRAWINGS

The accompanying drawings are included to provide a further understanding of the present invention, and constitutes part of this specification, together with the embodiment of the present invention serves to explain the invention, and is not construed as limited to the present invention. In the drawings.

Figure 1:
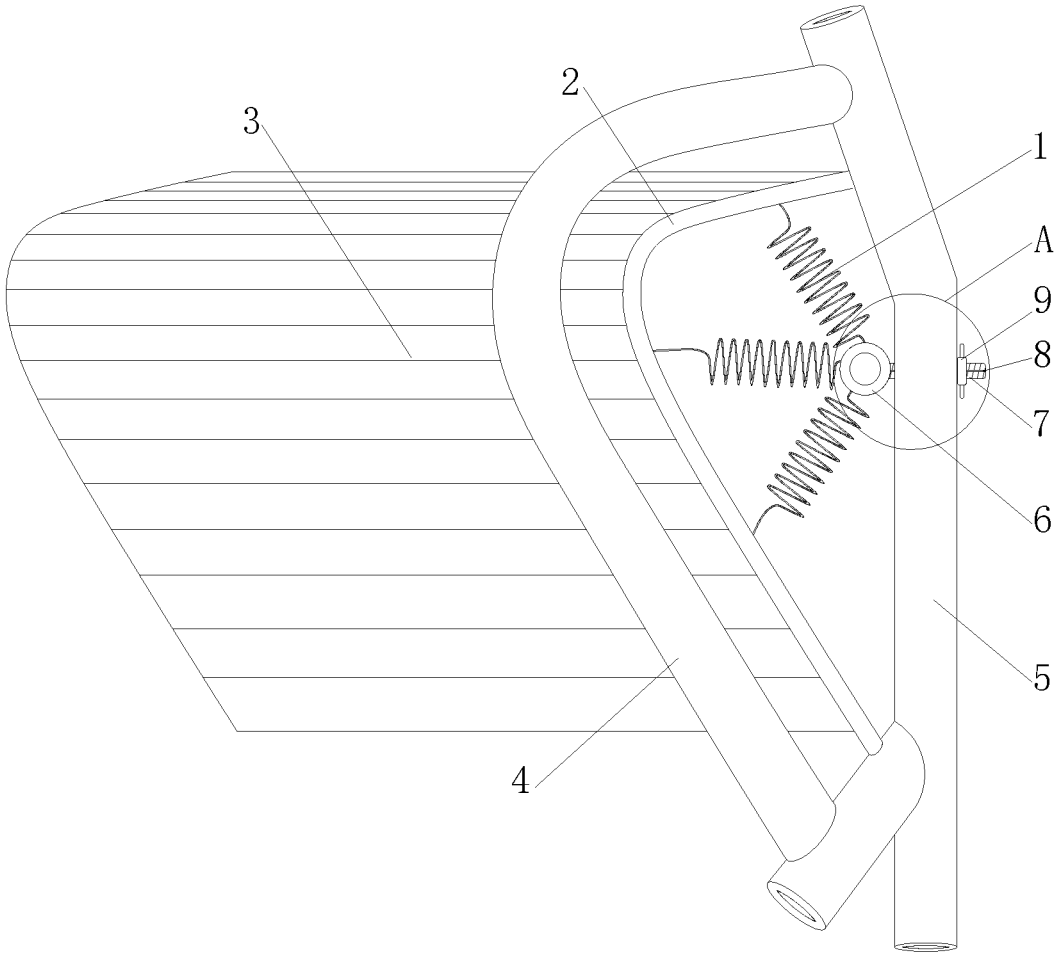
FIG. 1 is a structural schematic diagram of the present invention.

Description of the reference numerals: 1. Spring body; 2. Reinforcement; 3. Mesh body; 4. Protective frame; 5. Chair body; 6. Connecting ring; 7. Adjusting rod; 8. Groove; 9. Swivel.

DETAILED DESCRIPTION OF PREFERRED EMBODIMENT

The technical solutions provided in the embodiment of the present invention will be described clearly and completely below in accordance with the drawings in the embodiment of the present invention. Apparently, the described embodiment is merely a part rather than all of the embodiments of the present invention. All other embodiments made by those of ordinary skill in the art based on the embodiment of the present invention without creative work shall fall within the protection scope of the present invention.

Embodiment

Figure 2:
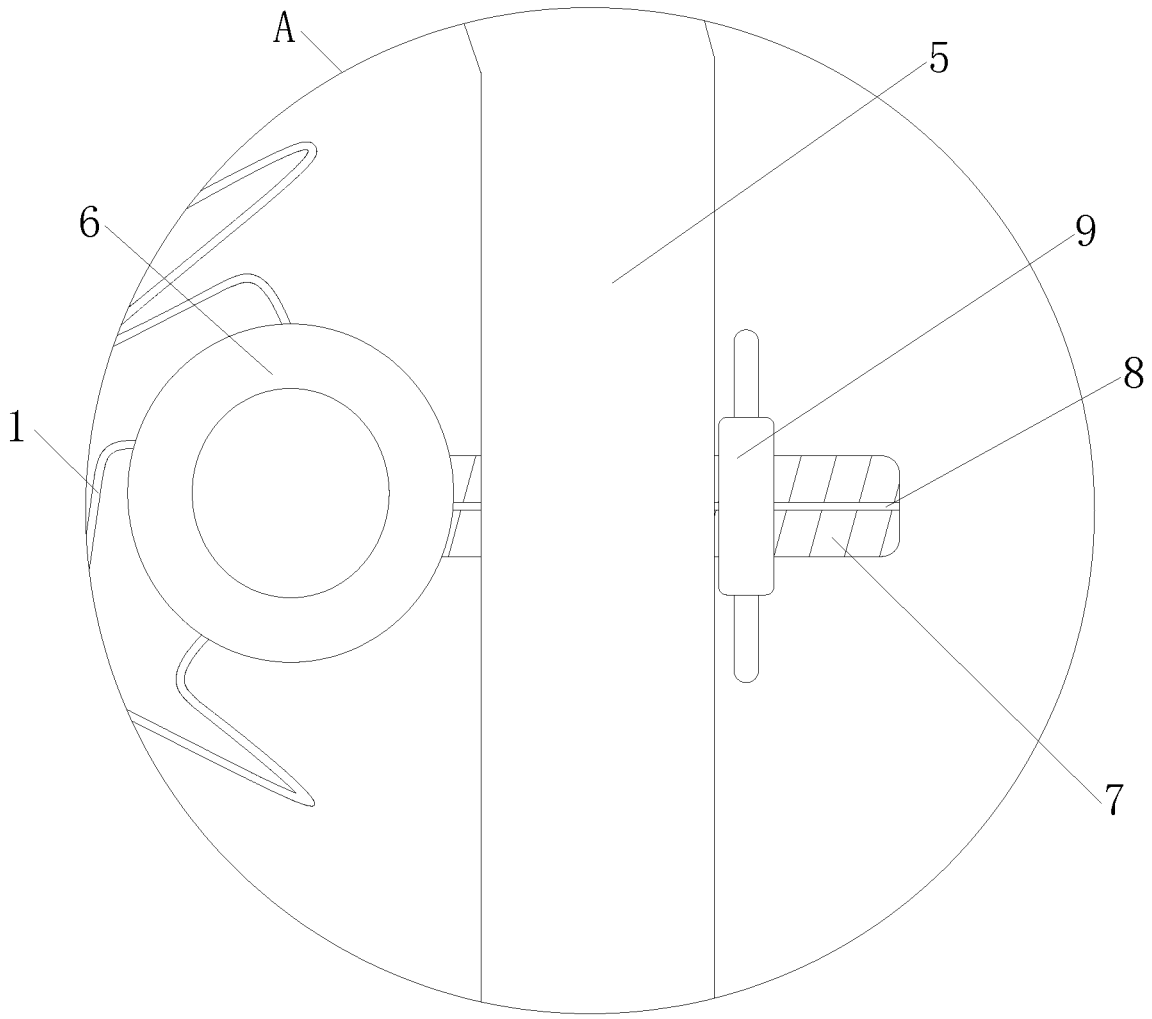
FIG. 2 is an enlarged structural diagram of Part A in FIG. 1 of the present invention.

As shown in FIGS. 1-2, the present invention provides the following technical solutions: A spring-type iron frame mesh chair, wherein it comprises the chair body 5, and the reinforcement 2 is fixed to the side of the chair body 5 by welding. The mesh body 3 is fixed on the side surface of the reinforcement 2. The spring bodies 1 are fixed on the inner side of the reinforcement 2 by welding. The connecting ring 6 is connected to one end of the spring bodies 1 different from the reinforcement 2. The adjusting rod 7 is integrally arranged on the side surface of the chair body 5. The adjusting rod 7 penetrates the side wall of the chair body 5. In this embodiment, the spring bodies 1 enable the mesh body 3 to have a certain elasticity, thereby improving the comfort of users.

Specifically, threads are evenly arranged on the outer surface of the adjusting rod 7. The swivel 9 is sleeved through screw threads on the outer surface at one end of the adjusting rod 7 different from the connecting ring 6. In this embodiment, the swivel 9 is used to adjust the position of the adjusting rod 7.

Specifically, the grooves 8 are evenly opened on the outer surface of the adjusting rod 7. Convex strips embedded into the adjusting rod 7 are arranged on the inner wall of the chair body 5. In this embodiment, the convex strips effectively prevent the adjusting rod 7 from rotating during position adjustment.

Specifically, three spring bodies 1 are arranged at an angle of 60° between adjacent two spring bodies 1. In this embodiment, the three spring bodies 1 with the same angular spacing provide the same tensile force throughout the mesh body 3.

Specifically, the protective frame 4 is arranged at the outer side of the reinforcement 2. Both ends of the protective frame 4 are connected to the chair body 5 by welding. In this embodiment, the protective frame 4 prevents the reinforcement 2 from being deformed by impact of external force.

Specifically, the swivel 9 is an annular component. Rotating rods are arranged at both ends of the swivel 9. In this embodiment, it is easy for users to turn the swivel 9 by manually operating the rotating rods to change the position of the adjusting rod 7.

The working principle and operating process of the present invention: When the mesh chair is in use, the spring bodies 1 can pull the reinforcement 2 by their own elasticity. Pressure is applied to the reinforcement 2 and the spring bodies 1 when the mesh body 3 is under pressure, so that the mesh body 3 becomes flexible and elastic to a certain extent, which improves the user experience. Users can also turn the swivel 9 manually to adjust the position of the adjusting rod 7 at the side of the chair body 5. When the adjusting rod 7 is adjusted, the position of the connecting ring 6 is changed simultaneously and the length of the spring bodies 1 varies, then the elasticity of the spring bodies 1 is changed. The grooves 8 prevent the adjusting rod 7 from rotating when the position of the adjusting rod 7 changes, which prevents the connecting ring 6 from rotating, and improves the stability of the spring bodies 1.

Finally, it should be noted that the above description is only a preferred embodiment of the present invention and is not intended to limit the present invention. Although the present invention has been described in detail with reference to the foregoing embodiment, those skilled in the art can still modify the technical solutions described in the foregoing embodiment, or substitute some of the technical features of the embodiment. Any modifications, equivalent substitutions, improvements, etc. made within the spirit and scope of the present invention should fall within the protection scope of the present invention.

What is claimed is:

1. A spring-type iron frame mesh chair, comprising a chair body (5), and a reinforcement (2) fixed to a side of the chair body (5) by welding;

a mesh body (3) fixed on a side surface of the reinforcement (2);

spring bodies (1) fixed on an inner side of the reinforcement (2) by welding;

a connecting ring (6) connected to one end of the spring bodies (1) different from the reinforcement (2); and an adjusting rod (7) integrally arranged on a side surface of the chair body (5), wherein the adjusting rod (7) penetrates a side wall of the chair body (5).

2. The spring-type iron frame mesh chair according to claim 1, wherein threads are evenly arranged on an outer surface of the adjusting rod (7); and a swivel (9) is sleeved through screw threads on the outer surface at one end of the adjusting rod (7) different from the connecting ring (6).

3. The spring-type iron frame mesh chair according to claim 1, wherein grooves (8) are evenly opened on an outer surface of the adjusting rod (7); and convex strips embedded into the adjusting rod (7) are arranged on an inner wall of the chair body (5).

4. The spring-type iron frame mesh chair according to claim 1, wherein three spring bodies (1) are arranged at an angle of 60° between adjacent two spring bodies (1).

5. The spring-type iron frame mesh chair according to claim 1, wherein a protective frame (4) is arranged at an outer side of the reinforcement (2); and both ends of the protective frame (4) are connected to the chair body (5) by welding.

6. The spring-type iron frame mesh chair according to claim 1, further comprising a swivel (9) comprising an annular component, wherein rotating rods are arranged at both ends of the swivel (9).

* * * * *